US011542785B2

(12) United States Patent
Abdelhamid et al.

(10) Patent No.: US 11,542,785 B2
(45) Date of Patent: Jan. 3, 2023

(54) DOWNHOLE GAS WELL FLOWBACK WITH ZERO OUTFLOW

(71) Applicant: Saudi Arabian Oil Company, Dhahran (SA)

(72) Inventors: Osama Abdelhamid, Dhahran (SA); Khaled Faleh, Dhahran (SA)

(73) Assignee: SAUDI ARABIAN OIL COMPANY

( * ) Notice: Subject to any disclaimer, the term of this patent is extended or adjusted under 35 U.S.C. 154(b) by 39 days.

(21) Appl. No.: 17/125,678

(22) Filed: Dec. 17, 2020

(65) Prior Publication Data

US 2022/0195846 A1 Jun. 23, 2022

(51) Int. Cl.

| | |
|---|---|
| ***E21B 41/00*** | (2006.01) |
| ***E21B 43/12*** | (2006.01) |
| ***E21B 49/08*** | (2006.01) |
| *E21B 33/12* | (2006.01) |
| *E21B 34/06* | (2006.01) |

(52) U.S. Cl.
CPC ..... *E21B 41/0057* (2013.01); *E21B 43/128* (2013.01); *E21B 49/087* (2013.01); *E21B 33/12* (2013.01); *E21B 34/06* (2013.01)

(58) Field of Classification Search
CPC .. E21B 41/0057; E21B 43/128; E21B 49/087; E21B 33/12; E21B 34/06
See application file for complete search history.

(56) References Cited

U.S. PATENT DOCUMENTS

| | | | | |
|---|---|---|---|---|
| 4,429,746 | A | 2/1984 | Allard | |
| 5,133,410 | A * | 7/1992 | Gadelle | E21B 43/18 166/308.1 |
| 5,366,011 | A | 11/1994 | Jennings, Jr. | |
| 5,605,193 | A | 2/1997 | Bearden | |
| 6,085,837 | A | 7/2000 | Massinon et al. | |
| 6,105,670 | A | 8/2000 | Klos | |
| 6,328,103 | B1 | 12/2001 | Pahmiyer | |
| 6,755,251 | B2 | 6/2004 | Thomas et al. | |
| 7,150,315 | B2 | 12/2006 | Michael et al. | |
| 8,584,749 | B2 | 11/2013 | Troshko et al. | |

(Continued)

FOREIGN PATENT DOCUMENTS

| | | |
|---|---|---|
| WO | 2010120806 A2 | 10/2010 |
| WO | 2000017485 A1 | 3/2020 |

OTHER PUBLICATIONS

Allen Best, "Do Oil and Water Mix?", Water Education Colorado, Oct. 1, 2013, pp. 1-9.

(Continued)

*Primary Examiner* — Kristyn A Hall

(74) *Attorney, Agent, or Firm* — Bracewell LLP; Constance Gall Rhebergen

(57) ABSTRACT

Systems and methods for managing flowback fluids produced during a flowback process in a well are provided. The system includes a well formed in a target zone in a hydrocarbon reservoir, where the well also extends to a disposal zone. The system also includes a check valve or zonal isolation systems. The method includes selecting a disposal zone, directing the formation of a well extending through a target zone and a disposal zone, transporting the flowback fluid from the target zone to the disposal zone during the flowback process, and selectively plugging the well near the disposal zone to prevent migration of the flowback fluid.

17 Claims, 3 Drawing Sheets

(56) References Cited

U.S. PATENT DOCUMENTS

| | | | | |
|---|---|---|---|---|
| 9,708,895 | B2 | 7/2017 | Bassett | |
| 11,203,918 | B2 | 12/2021 | Abdelhamid et al. | |
| 2002/0059866 | A1* | 5/2002 | Grant | F04D 25/0686 96/208 |
| 2008/0093085 | A1* | 4/2008 | Knight | E21B 43/128 166/105 |
| 2012/0128424 | A1 | 5/2012 | St. Clergy et al. | |
| 2014/0048257 | A1 | 2/2014 | Hunter | |
| 2014/0158352 | A1 | 6/2014 | Ramsey et al. | |
| 2017/0152728 | A1 | 6/2017 | Abou-Sayed et al. | |
| 2018/0274334 | A1 | 9/2018 | Fuchs et al. | |
| 2021/0254434 | A1* | 8/2021 | Abdelhamid | E21B 49/00 |

OTHER PUBLICATIONS

Menefee, et al., Wastewater management strategies for sustained shale gas production, Environmental Research Letters, vol. 15, No. 2, Jan. 20, 2020, 24001, XP020351001, 8 pgs.

Olsson, et al.,Hydraulic fracturing wastewater in Germany: composition, treatment, concerns, Environmental Earth Sciences, Springer Berlin Heidelberg, vol. 70, No. 8, May 31, 2013, pp. 3895-3906, XP036090555, ISSN: 1866-6280, DOI: 10.1007/S12665-013-25.

PCT/US2021/063550 International Search Report and Written Opinion dated Mar. 16, 2022, 13 pgs.

* cited by examiner

DOWNHOLE GAS WELL FLOWBACK WITH ZERO OUTFLOW

FIELD

This disclosure relates to systems and methods for disposal of wellbore pre-production fluids. More specifically, this disclosure relates to disposal of flowback fluids generated during a wellbore flowback process.

BACKGROUND

During the process of bringing a gas well online, a flowback process is performed before stable production of hydrocarbons can begin. Flowback is performed after drilling and completion (including hydraulic fracturing or stimulation) of the well, often when the rig is still on location. During the flowback process, fluids used to drill, complete, and stimulate the well are removed from the reservoir rock. Flowback is also performed to test the capacity of flow of the well and estimate reservoir deliverability.

Flowback fluid, or the fluids produced during the flowback process, can include oil, gas, oily solids, rock cuttings, sand particles, oily sludge, tar, oil/water emulsions, drilling completion fluids, and stimulation fluids such as acids or fracking fluids. Traditionally, gas produced during this phase is flared or vented to the atmosphere, and flowback fluids are stored in tanks or open pits.

Due to the uncontrollable nature of the flowback process, it can be difficult to capture the produced gas. Even operating a flaring system to burn the produced gases can be difficult due to the unpredictable nature of the flowback process. If burned in an uncontrolled manner, gases produced by the flowback process can pose a danger to the health and safety of stakeholders and to the environment. Even when burned, $H_2S$, $CO_2$, and other pollutants are still released to the atmosphere. Once brought to the surface, flowback fluids have to be treated or disposed of, and require space to store and move.

The current methods of dealing with flowback fluids and gases from the flowback process are costly and can be unsafe or harmful to the environment. Therefore, a safer, more cost effective way of managing flowback fluids would be advantageous.

SUMMARY

The disclosure relates to methods and systems for managing fluids produced from a well during the flowback process. More specifically, the disclosure relates to disposing of flowback fluids in a disposal zone in a subterranean formation during the flowback process. As stated previously, there are high costs and other health and safety, and environmental concerns associated with traditional flowback processes. Systems and methods that manage flowback fluids without bringing the flowback fluids to the surface are advantageous. Therefore, disclosed herein are methods and systems to dispose of flowback fluids generated from the well flowback process with well components that can be retrieved from the well after flowback is completed.

In an aspect, a method for managing well flowback fluids associated with preparing a well extending through a target zone of a hydrocarbon reservoir in a subterranean formation for production is provided, where the method includes the step of selecting a disposal zone along the well in a subterranean formation. The disposal zone has an appropriate permeability and an injectivity index so that the disposal zone can accept a flowback fluid at a predetermined required rate. The method also includes the steps of generating the flowback fluid from the target zone and transporting the flowback fluid from the target zone into the disposal zone. In some aspects, the flowback fluid includes fluids generated during a group of activities selected from drilling, fracturing, well completion, well testing, well cleaning, and combinations of the same. In other aspects, the method further includes preventing the flowback fluid from leaving the disposal zone and re-entering the target zone by utilizing a check valve, and selectively plugging the disposal zone.

In certain aspects, the hydrocarbon reservoir is a gas reservoir. In some aspects, the step of transporting the flowback fluid from the target zone into the disposal zone occurs by the use of a force, where the force can be from the group of hydrostatic pressure, reservoir natural flow, gravity force, pressure generated by a downhole gas compressor, or combinations of the same.

In some aspects, the method further includes the steps of inserting the downhole compressor into the well, where the downhole compressor can provide artificial lift to transport the flowback fluid into the disposal zone, and removing the downhole gas compressor after the flowback fluid is transported into the disposal zone. In some aspects, the downhole gas compressor is a downhole multistage gas compressor.

In certain aspects, the method does not include the separation of components in the flowback fluid, and the method is performed where no separation of the components of the flowback fluid occurs. In some aspects, the flowback fluid is fully transported to the disposal zone so that no flowback fluid is transported out of the subterranean formation, such as to the surface.

In some aspects, the method further includes the step of testing the well, so that the testing is used to analyze the well and estimate properties of the hydrocarbon reservoir. In some aspects, the step of selecting the disposal zone in the subterranean formation further includes selecting the disposal zone such that an impermeable rock layer exists between the disposal zone and the target zone. In some aspects, the method further includes the step of installing a zonal isolation system which operates to isolate portions of the well.

In a second aspect, a system for managing well flowback fluids associated with preparing the well for production in hydrocarbon reservoirs is provided. The system includes the well extending through the target zone. The well operates to produce hydrocarbons from the target zone of the hydrocarbon reservoir. The well further extends through the disposal zone, where the disposal zone operates to accept the flowback fluid generated after well completion. The system further includes the check valve installed between the target zone and the disposal zone, which operates to prevent the flowback fluid from exiting the disposal zone through the well.

In some aspects, the system further includes the downhole gas compressor, which operates to provide artificial lift to transport the flowback fluid into the disposal zone. In some aspects, the target zone and the disposal zone are both part of the hydrocarbon reservoir. In other aspects, the disposal zone is not a part of the hydrocarbon reservoir, but the disposal zone is part of the subterranean formation. In some aspects, the target zone is separated from the disposal zone by the impermeable rock layer. In some aspects, the target zone is deeper than the disposal zone. In some aspects, the disposal zone is deeper than the target zone. In some aspects, the system further includes the zonal isolation system, which operates to isolate the disposal zone from other portions of the well. In some aspects, where the hydrocarbon reservoir is the oil reservoir, the system also includes an inverted electrical submersible pump, which operates to provide artificial lift to transport the flowback fluid into the disposal zone.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the scope as it can admit to other equally effective embodiments.

DETAILED DESCRIPTION

Figure 1:
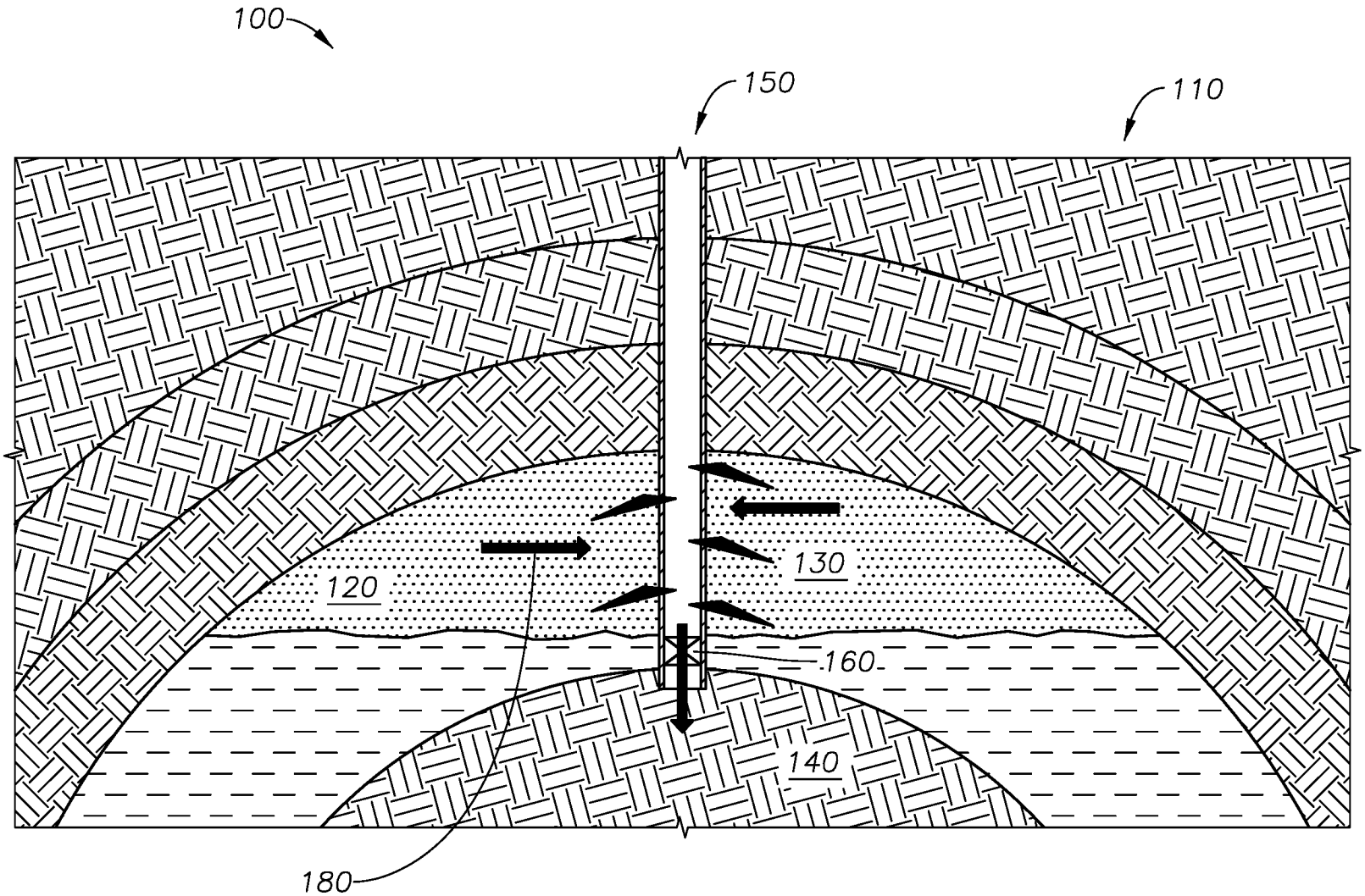
FIG. 1 is a pictorial representation of a gas reservoir with a disposal zone for disposing of flowback fluids, according to an embodiment.

While the disclosure will be described with several embodiments, it is understood that one of ordinary skill in the relevant art will appreciate that many examples, variations and alterations to the system and methods described are within the scope and spirit of the disclosure. Accordingly, the embodiments of the disclosure described are set forth without any loss of generality, and without imposing limitations, on the claims.

Embodiments of systems and methods to manage and dispose of flowback fluids downhole are described as follows. The systems and methods to manage and dispose of flowback fluids can be used in oil-containing formations, natural-gas-containing formations, water-containing formations, or any other formation. In preferred embodiments, the systems and methods are deployed in gas reservoirs, and downhole multistage gas compressors are utilized. In other embodiments, the systems and methods are deployed in oil reservoirs, and an inverted electrical submersible pump is used downhole if necessary.

In some embodiments of the present disclosure, methods for management well flowback fluids in hydrocarbon reservoirs are provided. The hydrocarbon reservoir can be the gas reservoir. The well can be formed in the subterranean formation. The well can be formed by any method, and can be any type of well, including vertical or horizontal wells. The well can be directed to be formed according to certain specifications such as the chosen subterranean formation, the chosen disposal zone, and the chosen target zone. The subterranean formation can include the target zone in the hydrocarbon reservoir. The target zone can be in the gas reservoir. The subterranean formation can further include the disposal zone.

The disposal zone is selected as a formation in the subterranean formation, and receives the flowback fluids from the target zone for disposal. The disposal zone can be part of the gas reservoir or hydrocarbon reservoir. The disposal zone can be a separate formation, or in the same formation, as the target zone. In certain embodiments where the disposal zone is a part of the target zone, it is preferred to select the disposal zone as a lower portion of the target zone, as the upper portion of the target zone is more likely to be the productive portion of the gas reservoir. The disposal zone preferably has no recoverable hydrocarbons. In some preferred embodiments, the disposal zone is deeper than the target zone in the subterranean formation. In other embodiments, the disposal zone is less deep than the target zone in the subterranean formation.

In some preferred embodiments, the target zone and the disposal zone are segregated so that material from the disposal zone is less likely to migrate into the target zone, or does not migrate into the target zone. When the disposal zone and the target zone are not segregated, well logs and collected data can reflect the migration of fluids from the disposal into the target zone. To develop the most accurate information, to preserve reservoir sweep zones, and to develop an more accurate calculation of the recovery factors of the reservoir, segregation between the target zone and the disposal zone should preferably be maintained. Segregation of the target zone and the disposal zone are not necessary to preserve reservoir sweep zones and develop calculations of the recovery factors of the reservoir, however. In some embodiments, the disposal zone is selected such that the impermeable rock layer separates the target zone and the disposal zone. In some of these embodiments, the impermeable rock layer prevents migration of the flowback fluids from the disposal zone into the target zone.

The disposal zone can be selected based on the disposal zone having the appropriate permeability, measured in millidarcies (mD), and the injectivity index to accept the flowback fluids at the predetermined required rate. The required rate can be predetermined using the expected rate of generation of flowback fluid or testing fluid used to test the well. The appropriate permeability for the disposal zone can be one that is greater than about 10 mD. In some embodiments, the disposal zone can have permeabilities in the range of about 10 mD to 1,000 mD. In cases where the injectivity index of the disposal zone is low, or the permeability of the disposal zone is low, the disposal zone can be stimulated to increase the injectivity index and permeability, such as by hydraulic fracturing or acid injection.

After the successful conclusion of the drilling, completion, and stimulation activities in the well, and while the rig is still deployed at the wellsite, the flowback process can begin. The flowback process can include injecting and disposing of fluids used to drill, complete, stimulate, clean, and/or test the well. In the embodiments disclosed herein, the flowback fluid is generated from the target zone during the flowback process. The flowback fluids are removed from the reservoir rock during the flowback process. The flowback process prepares the well for hydrocarbon production.

The flowback fluids can include hydrocarbons including oil and gas, water, oil/water emulsions, drilling and completion fluids, and/or stimulation fluids such as acids or hydraulic fracturing fluids, and other solids or suspended solids such as oily solids, rock cuttings, sand particles, oily sludge, and/or tar. The flowback fluids can include fluids generated during drilling, fracturing, stimulating, completing, testing, cleaning, servicing, and/or otherwise preparing the well for production.

In the embodiments of the present disclosure, flowback fluid is transported from the target zone into the disposal zone. During the movement of the flowback fluid to the disposal zone, no separation of the components of the flowback fluid occurs. Instead, all gas, liquid, and solids in the flowback fluids (either dissolved or suspended) are forced into the disposal zone. Additionally, the flowback fluid is not transported out of the well or to the surface.

In embodiments of the present disclosure, the method further includes transporting the flowback fluid generated in the target zone from the target zone and into the disposal zone. In some embodiments, this transportation is performed by reservoir natural flow, gravity force, or hydrostatic head. In other embodiments, additional artificial force is generated with the downhole gas compressor. In some embodiments, the downhole gas compressor is the downhole multistage gas compressor. In some embodiments, multiple forces work together to transport the flowback fluid from the target zone to the disposal zone. In some embodiments, the downhole gas compressor can be installed in the wellbore during the flowback process. Therefore, when the flowback process is complete and the disposal zone is no longer needed or advantageous for flowback fluid disposal, the compressor can be removed from the well before production starts.

In some embodiments, the flowback fluid is prevented from leaving the disposal zone and re-entering the target zone by using the check valve in the wellbore. The check valve prevents backflow from the disposal zone into the target zone. Additionally, the check valve can be designed to open automatically based upon pressure buildup. The check valve can be any type of check valve known in the art and can be any type of valve that allows fluid to flow in only one direction. The method can further include selectively plugging the disposal zone after the flowback process is complete. Selectively plugging the disposal zone ensures that the flowback fluids do not travel through the well to the target zone or to the surface during the production phase. In certain embodiments where the disposal zone is a part of the target zone, plugging the disposal zone may not be necessary.

In some embodiments, the zonal isolation system can be installed in the wellbore. The zonal isolation system can include check-valves, plugs, packers, any isolation system known in the art, and the like. The isolation system prevents the flowback fluid from going further up or down the wellbore away from the target zone. In some embodiments, the isolation system prevents the flowback fluid from traveling up the wellbore to the surface. In some embodiments, the isolation system prevents the flowback fluid from traveling past the disposal zone in the wellbore. In some embodiments, the isolation system prevents the flowback fluid from traveling past the target zone in the wellbore. The check valves and the zonal isolation systems can be placed in a variety of locations in the well in order to achieve a segregation of the disposal zone, the target zone, and the surface.

In some embodiments, systems for managing well flowback fluids associated with preparing the well for production in hydrocarbon reservoirs are provided. The system can include the well. The well can be the same type of well in the same type of hydrocarbon reservoirs as disclosed above. The well extends through the target zone and the disposal zone of the hydrocarbon reservoir. The target zone and the disposal zone can have the same characteristics as previously described. The well can require cleaning and testing before production of hydrocarbons, thus generating flowback fluids after well completion. The system can also include the check valve, installed between the target zone and the disposal zone in the well. In some embodiments, the system includes the downhole gas compressor and the zonal isolation systems, as discussed above. The downhole gas compressor can include systems to minimize the liquid impact by utilizing in compressor gas-liquid separators.

Referring now to FIG. 1, flowback disposal system 100 is shown according to an embodiment. Subterranean formation 110 has multiple stratum. Subterranean formation 110 includes hydrocarbon reservoir 120. Hydrocarbon reservoir 120 includes target zone 130. Disposal zone 140 is not separated from target zone 130 by an impermeable layer of rock. Instead, disposal zone 140 is only a separate portion of the subterranean formation 110 near the hydrocarbon reservoir 120, but is not a part of the target zone 130. Well 150 extends from the surface (not pictured) through subterranean formation 110, hydrocarbon reservoir 120, target zone 130, and disposal zone 140.

The flowback fluid (not pictured) moves from the target zone 130 into well 150, towards disposal zone 140 according to direction of travel of flowback fluid 180. Check valve 160 is installed in well 150 between target zone 130 and disposal zone 140. Check valve 160 prevents the flowback fluid from traveling opposite of the desired direction of travel of flowback fluid 180.

Figure 2:
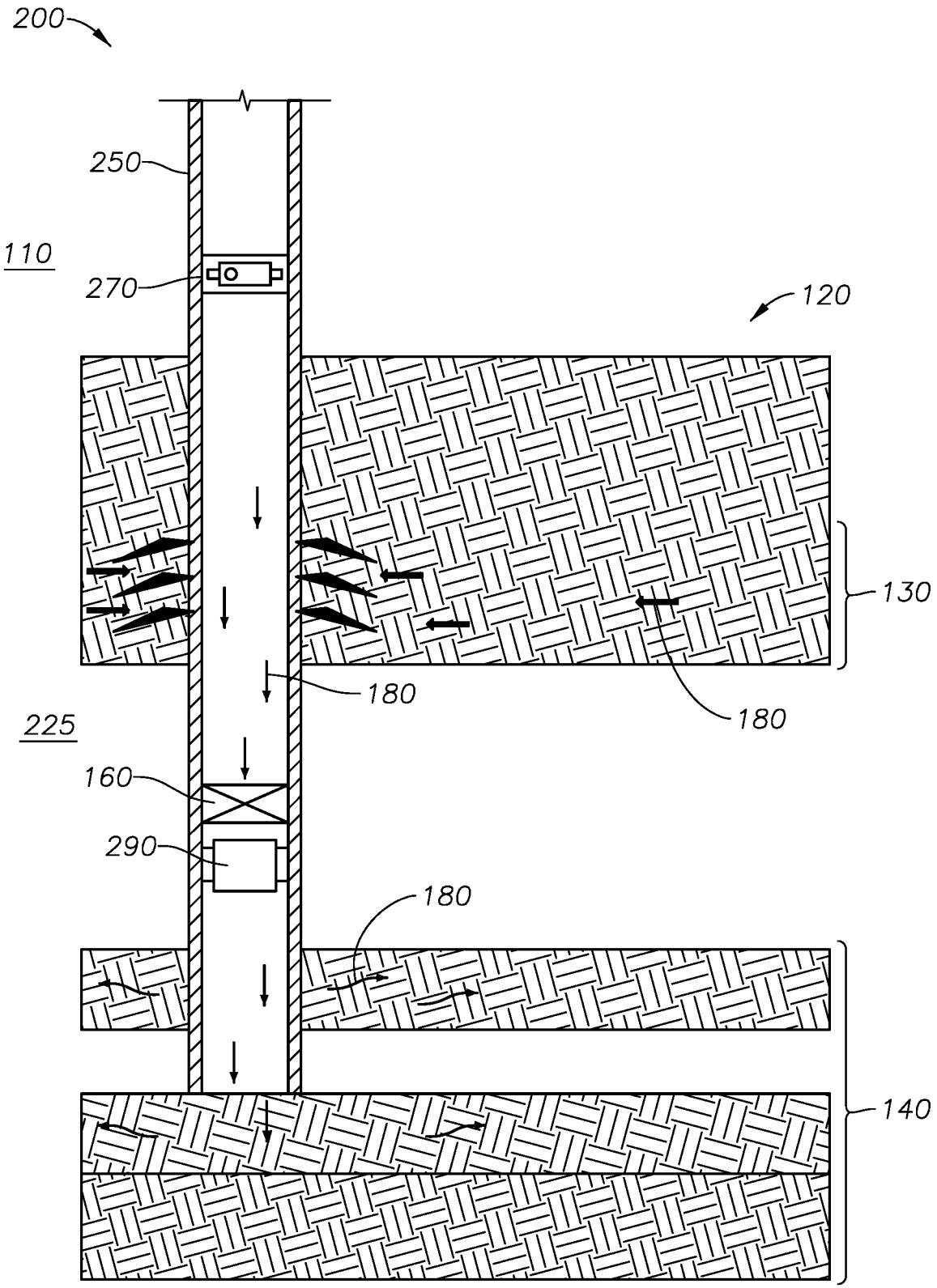
FIG. 2 is a schematic of a flowback disposal system deployed in a vertical well, according to an embodiment.

Referring to FIG. 2, vertical well flowback disposal system 200 is shown. Vertical well 250 is formed in subterranean formation 110. Subterranean formation 110 includes target zone 130, which is part of hydrocarbon reservoir 120. Subterranean formation 110 also includes disposal zone 140 and impermeable rock seal 225. Impermeable rock seal 225 lies between target zone 130 and disposal zone 140. Disposal zone 140 has been selected to be deeper than target zone 130. In some embodiments, disposal zone 140 is selected as to be shallower (closer to the surface) than target zone 130. The flowback fluid (not pictured) travels in direction of travel of flowback fluid 180 from target zone 130 to vertical well 250. Zonal isolation system 270 prevents the flowback fluid from traveling up vertical well 250 towards the surface (not pictured). Zonal isolation system 270 can be installed anywhere above target zone 130 when disposal zone 140 is located deeper than target zone 130. In embodiments where target zone 130 is deeper than disposal zone 140, zonal isolation system 270 can be installed anywhere above disposal zone 140. The flowback fluid (not pictured) travels downward in vertical well 250 towards disposal zone 140 in direction of travel of flowback fluid 180 through check valve 160. The flowback fluid (not pictured) passes through downhole gas compressor 290. Downhole gas compressor 290 provides artificial lift to transport the flowback fluids (not pictured) to disposal zone 140. In some embodiments, downhole gas compressor 290 is located between zonal isolation system 270 and check valve 160. In some embodiments, hydrocarbon reservoir 120 is an oil reservoirs, the downhole gas compressor 290 is an inverted electrical submersible pump.

After successful completion of the well, including stimulation, installation of zonal isolation system 270 and check valve 160 can occur, followed by the flowback operations. The reservoir pressure from hydrocarbon reservoir 120 forces the flowback fluid from target zone 130 to disposal zone 140. The flowback fluid flow generated by the reservoir pressure in the target zone 130 can be further propelled by the hydrostatic fluid pressure of the fluids in vertical well 250. If the combination of the reservoir pressure of target zone 130 and the hydrostatic head of the flowback fluid in vertical well 250 are sufficient to overcome the reservoir pressure of disposal zone 140, the flow of the flowback fluid from target zone 130 into disposal zone 140 is automatic and needs no additional force. If the combination of the reservoir pressure of target zone 130 and the hydrostatic head of the flowback fluid in vertical well 250 is not sufficient to overcome the reservoir pressure of disposal zone 140, the flow of the flowback fluid from target zone 130 into disposal zone 140 requires external support such as downhole gas compressor 290.

During the method disclosed herein, real time pressure, temperature, and production data can be recorded using feedback and sensor data from downhole gas compressor 290. The data collected can be communicated to the surface, providing valuable information about hydrocarbon reservoir 120, target zone 130, and disposal zone 140, as well as providing surveillance and monitoring for the flowback process.

After the flowback process in complete, additional well testing and well cleanup procedures can be performed to analyze conditions downhole. The well tests can include production tests to collect data to measure, analyze, and understand the well behavior in real time. Other well tests that can be performed include hydrocarbon property analysis, reservoir temperature and pressure analysis, drainage area and shape analysis, water-to-oil, gas-to-oil ratios, capacity, and deliverability analysis. The fluids from the well test can also be disposed of similarly to the flowback fluids. The additional well testing using the methods and systems disclosed herein has the additional advantage of providing results with no wellbore storage effects recorded in the test.

After flowback, testing, and additional procedures are completed, zonal isolation system 270, check valve 160, and downhole gas compressor 290 can be removed from vertical well 250. Zonal isolation system 270, check valve 160, and downhole gas compressor 290 can be reused at other wellsites. Disposal zone 140 is plugged to prevent additional flow of fluids or hydrocarbons from entering disposal zone 140 during the production stages.

Figure 3:
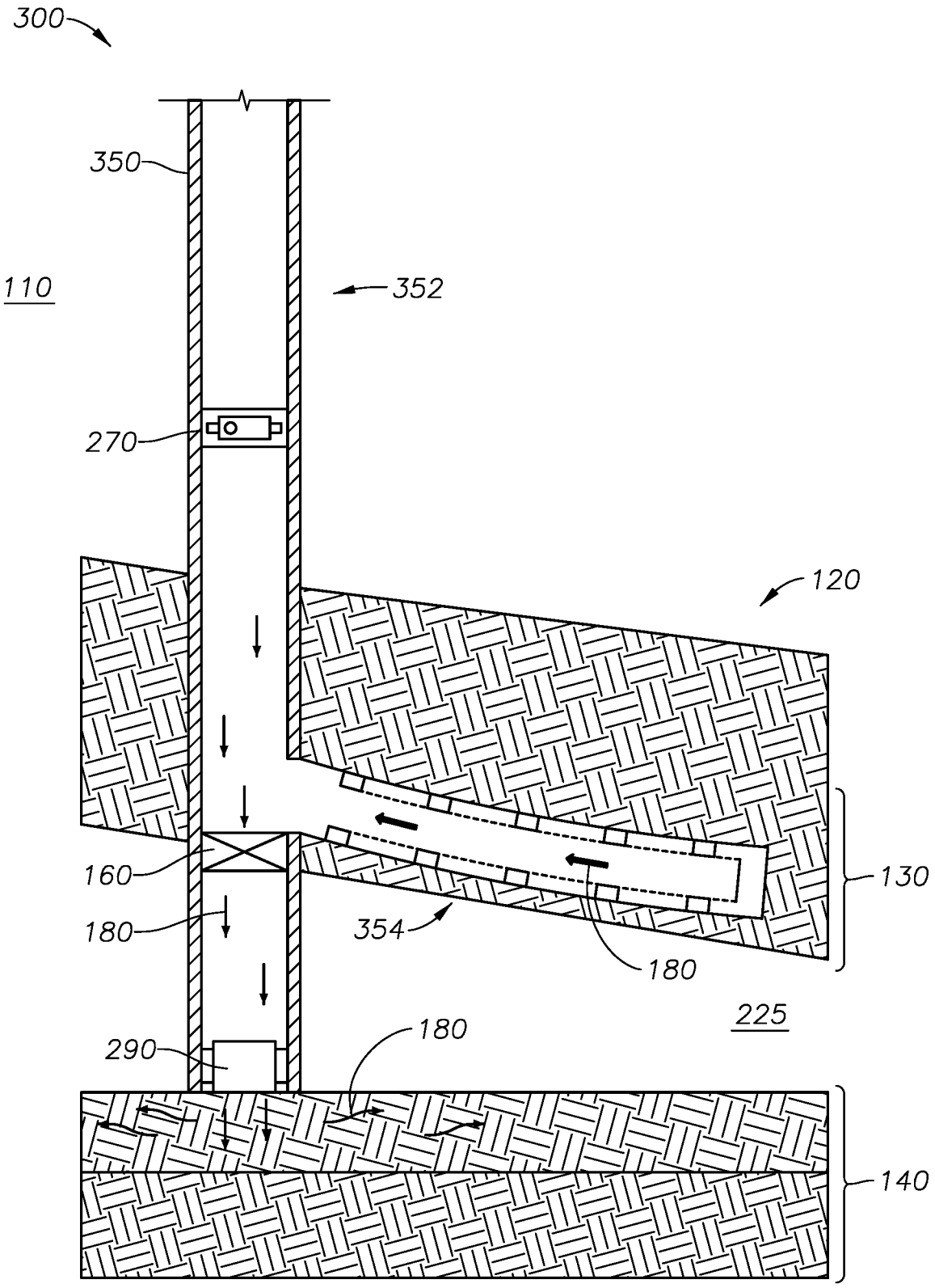
FIG. 3 is a schematic of a flowback disposal system deployed in a horizontal well, according to an embodiment.

Referring to FIG. 3, horizontal well flowback disposal system 300 is shown. Horizontal well 350 with vertical portion 352 and horizontal portion 354 is formed in subterranean formation 110. Subterranean formation 110 includes target zone 130, which is part of hydrocarbon reservoir 120. Subterranean formation 110 also includes disposal zone 140 and impermeable rock seal 225. Impermeable rock seal 225 lies between target zone 130 and disposal zone 140. Disposal zone 140 has been selected to be deeper than target zone 130. In some embodiments, disposal zone 140 is selected to be less deep than target zone 130. The flowback fluid (not pictured) travels in direction of travel of flowback fluid 180 from target zone 130 into horizontal portion 354 of horizontal well 350. Zonal isolation system 270 prevents the flowback fluid from traveling up vertical portion 352 of horizontal well 350 towards the surface (not pictured). Zonal isolation system 270 can be installed anywhere above target zone 130 when disposal zone 140 is located deeper than target zone 130. In embodiments where target zone 130 is deeper than disposal zone 140, zonal isolation system 270 can be installed anywhere above disposal zone 140. The flowback fluid (not pictured) travels downward in vertical portion 352 of horizontal well 350 towards disposal zone 140 in direction of travel of flowback fluid 180 through check valve 160. The flowback fluid (not pictured) passes through downhole gas compressor 290. Downhole gas compressor 290 provides artificial lift to transport the flowback fluid (not pictured) to disposal zone 140. In some embodiments, downhole gas compressor 290 is located between zonal isolation system 270 and check valve 160.

After successful completion of the well, including stimulation, installation of zonal isolation system 270 and check valve 160 can occur, followed by the flowback operations. The reservoir pressure from hydrocarbon reservoir 120 forces the flowback fluid from target zone 130 to disposal zone 140. The flowback fluid flow generated by the reservoir pressure in the target zone 130 can be further propelled by the hydrostatic fluid pressure of the fluids in horizontal well 350. If the combination of the reservoir pressure of target zone 130 and the hydrostatic head of the flowback fluid in horizontal well 350 are sufficient to overcome the reservoir pressure of disposal zone 140, the flow of the flowback fluid from target zone 130 into disposal zone 140 is automatic and needs no additional force. If the combination of the reservoir pressure of target zone 130 and the hydrostatic head of the flowback fluid in horizontal well 350 is not sufficient to overcome the reservoir pressure of disposal zone 140, the flow of the flowback fluid from target zone 130 into disposal zone 140 requires external support such as downhole gas compressor 290.

Advantages of the invention disclosed herein include benefits to health and safety. Since there is no flowback to the surface, the fluids and gases—including sour gases containing $H_2S$—are not be released to atmosphere. The invention eliminates the need to neutralize sour hydrocarbons. There are additional environmental benefits to using the invention disclosed herein, including no release of hydrocarbons to the surface environment, no storing of fluids in pits or tanks, no venting of gases, and no flaring. Due to difficulty of capture, any gas injected into the disposal zone during the flowback process would most likely have been flared using traditional flowback methods, so there is little to no profitable gas loss using the present process as compared to previously utilized processes. There are no additional wastes generated from using the methods and systems disclosed herein.

Other advantages of the presently disclosed invention include the ability to generate and collect accurate data on the well and reservoir during the flowback process. Downhole real time pressure and production data can be acquired during the flowback process, effectively yielding a well test and providing valuable insight into reservoir properties. Additional well tests can also be performed with the systems in place so as to dispose of the material generated during the test, preventing the generation of wastes at the surface. Due to the isolation systems and the disposal of the fluids generated during the tests, the wellbore storage effect is effectively eliminated from the well testing analysis.

Additional advantages of the methods and systems disclosed herein include the clean-up of reservoirs with tight formations where debris and mud residues are removed from the reservoir without flaring of gas. The clean-up and flowback methods disclosed herein prepare the well for production and remove and dispose of elements that can interfere with the optimal efficiency of the well without damaging the well's integrity or bringing the wastes through the entirety of the wellbore. Additionally, the methods can assist in a trouble-free completion and can optimize productivity of the well. Other advantages include minimizing the possibility of liquid slugging and eliminating liquid hold-up in the wellbore. For onshore or offshore environments with limited surface space, the methods and systems are advantageous since there is no above-ground footprint and no need for a flare or fluid storage during the flowback process. Additionally, there is little capital cost lost during the flowback process disclosed herein since the downhole gas compressor and isolation systems are removable, and are generally only used for short periods of time, such as 12 hours to 48 hours. Advantageously, due to the additional downhole gas compressor, there is no need to rely on gravity alone to transport the fluids or separate components for disposal in the disposal zone, so the disposal zone can be shallower than the target zone.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

As used in the specification and in the appended claims, the words "comprise," "has," and "include" and all grammatical variations thereof are each intended to have an open, non-limiting meaning that does not exclude additional elements or steps.

What is claimed is:

1. A method for managing well flowback fluids associated with preparing a well extending through a target zone of a hydrocarbon reservoir in a subterranean formation for production, the method comprising the steps of:

selecting a disposal zone along the well in the subterranean formation, the disposal zone having an appropriate permeability and an injectivity index operable to accept a flowback fluid at a predetermined required rate;

installing a zonal isolation system that isolates a full diameter of the well above the disposal zone and the target zone, operable to isolate vertical sections of the well;

generating the flowback fluid from the target zone of the hydrocarbon reservoir, wherein the hydrocarbon reservoir is a gas reservoir; and transporting the flowback fluid from the target zone into the disposal zone.

2. The method according to claim 1, wherein the flowback fluid includes fluids generated from a group of activities selected from the following: drilling, fracturing, well completion, well testing, well cleaning, and combinations of the same.

3. The method according to claim 1, further comprising the steps of:

preventing the flowback fluid from leaving the disposal zone and re-entering the target zone by utilizing a check valve; and selectively plugging the disposal zone.

4. The method according to claim 1, wherein the step of transporting the flowback fluid from the target zone into the disposal zone occurs by the use of a force selected from the group consisting of: hydrostatic pressure, reservoir natural flow, gravity force, pressure generated by a downhole gas compressor, and combinations of the same.

5. The method according to claim 4, wherein the downhole gas compressor is a downhole multistage gas compressor.

6. The method according to claim 1, further comprising the steps of:

inserting a downhole gas compressor into the well, the downhole gas compressor operable to provide artificial lift to transport the flowback fluid into the disposal zone; and removing the downhole gas compressor after the flowback fluid is transported into the disposal zone.

7. The method according to claim 1, wherein no separation of components of the flowback fluid occurs.

8. The method according to claim 1, wherein the flowback fluid is fully transported to the disposal zone such that none of the flowback fluid is transported out of the subterranean formation.

9. The method according to claim 1, further comprising the step of testing the well, such that the testing is used to analyze the well and estimate properties of the hydrocarbon reservoir.

10. The method according to claim 1, wherein the step of selecting the disposal zone in the subterranean formation further comprises selecting the disposal zone such that an impermeable rock layer exists between the disposal zone and the target zone.

11. A system for managing well flowback fluids associated with preparing a well for production in hydrocarbon reservoirs, the system comprising:

a well, the well extending through a target zone and operable to produce hydrocarbons from the target zone of a hydrocarbon reservoir, wherein the hydrocarbon reservoir is a gas reservoir, the well further extending through a disposal zone, the disposal zone operable to accept a flowback fluid generated after well completion;

a zonal isolation system that isolates a full diameter of the well above the disposal zone and the target zone, operable to isolate vertical sections of the well; and a check valve installed between the target zone and the disposal zone, operable to prevent the flowback fluid from exiting the disposal zone through the well.

12. The system of claim 11, the system further comprising a downhole gas compressor, the downhole gas compressor operable to provide artificial lift to transport the flowback fluid into the disposal zone.

13. The system of claim 11, wherein the target zone and the disposal zone are both part of the hydrocarbon reservoir.

14. The system of claim 11, wherein the disposal zone is not a part of the hydrocarbon reservoir.

15. The system of claim 14, wherein the target zone is separated from the disposal zone by an impermeable rock layer.

16. The system of claim 15, wherein the target zone is deeper than the disposal zone.

17. The system of claim 15, wherein the disposal zone is deeper than the target zone.

* * * * *